US008535605B2

(12) United States Patent
Orth et al.

(10) Patent No.: US 8,535,605 B2
(45) Date of Patent: Sep. 17, 2013

(54) METHOD OF PRODUCING A SINTER-HARDENED COMPONENT

(75) Inventors: Peter Orth, Stadl-Paura (AT); Gerold Stetina, Voecklabruck (AT)

(73) Assignee: MIBA Sinter Austria GmbH, Laakirchen (AT)

( * ) Notice: Subject to any disclaimer, the term of this patent is extended or adjusted under 35 U.S.C. 154(b) by 706 days.

(21) Appl. No.: 12/733,456

(22) PCT Filed: May 29, 2008

(86) PCT No.: PCT/EP2008/004270

§ 371 (c)(1), (2), (4) Date: Mar. 2, 2010

(87) PCT Pub. No.: WO2009/030290

PCT Pub. Date: Mar. 12, 2009

(65) Prior Publication Data

US 2011/0008639 A1 Jan. 13, 2011

(30) Foreign Application Priority Data

Sep. 3, 2007 (AT) ..... A 1371/2007

(51) Int. Cl.
*B22F 3/10* (2006.01)

(52) U.S. Cl.
USPC ..... 419/57; 419/25; 419/29; 419/38; 419/46; 419/56; 428/547

(58) Field of Classification Search
USPC ..... 419/56, 57
See application file for complete search history.

(56) References Cited

U.S. PATENT DOCUMENTS

| | | | | |
|---|---|---|---|---|
| 2,637,671 | A * | 5/1953 | Pavitt | 419/25 |
| 4,253,874 | A | 3/1981 | Cundill | |
| 4,266,974 | A | 5/1981 | Nitta et al. | |
| 5,777,247 | A | 7/1998 | Garg et al. | |
| 6,120,727 | A | 9/2000 | Asaka et al. | |
| 7,314,498 | B2 | 1/2008 | Nigarura et al. | |
| 2006/0081089 | A1 | 4/2006 | Nigarura et al. | |

FOREIGN PATENT DOCUMENTS

| | | |
|---|---|---|
| DE | 26 44 918 | 4/1978 |
| DE | 26 50 766 | 5/1978 |
| DE | 199 44 522 | 3/2000 |
| DE | 695 30 129 | 12/2003 |
| DE | 11 2005 002 568 | 9/2007 |
| EP | 0 105 138 | 4/1984 |
| EP | 0 835 329 | 4/1998 |
| JP | 55-044567 | 3/1980 |

(Continued)

OTHER PUBLICATIONS

Paul Johnson, "Furnace Atmospheres," ASM Handbook vol. 4 (1991), pp. 542-567.*

(Continued)

*Primary Examiner* — George Wyszomierski
*Assistant Examiner* — Christopher Kessler
(74) *Attorney, Agent, or Firm* — Collard & Roe, P.C.

(57) ABSTRACT

The invention describes a method of producing a sinter-hardened component from a metallic powder containing chromium which is pre-alloyed in particular, comprising the steps of compacting the powder to form a green compact and then sintering the green compact in a reducing sintering atmosphere at a sintering temperature in excess of 1100° C. A gas containing carbon is added to the sintering atmosphere.

9 Claims, 1 Drawing Sheet

(56) References Cited

FOREIGN PATENT DOCUMENTS

| | | |
|---|---|---|
| JP | 57-073156 | 5/1982 |
| JP | 62-218501 | 9/1987 |
| JP | 63-038566 | 2/1988 |
| JP | 2000-087115 | 3/2000 |
| WO | WO 97/01651 | 1/1997 |

OTHER PUBLICATIONS

International Search Report.
Written Opinion of the International Searching Authority.
Ratzi R et al: "Sinterhardening reduces costs for manual transmission synchronizer parts". Metal Powder Report, MPR Publishing Services, Shrewsbury, GB, vol. 55, No. 7-8, Jul. 1, 2000, pp. 20-22 and 24-25, XP004289816, ISSN: 0026-0657 (ISR).
G. Stetina et al., "*Low Alloyed High Performance Material Concepts*," Miba Sinter Austria GmbH; Advanced Manuscript provided as a reference for attendees of the 2008 World Congress on Powder Metallurgy & Particulate Materials, Jun. 2008, pp. 1-6, and Technical Sessions Brochure for the 2008 World Congress on Powder Metallurgy & Particulate Materials (pp. 16-23).

* cited by examiner

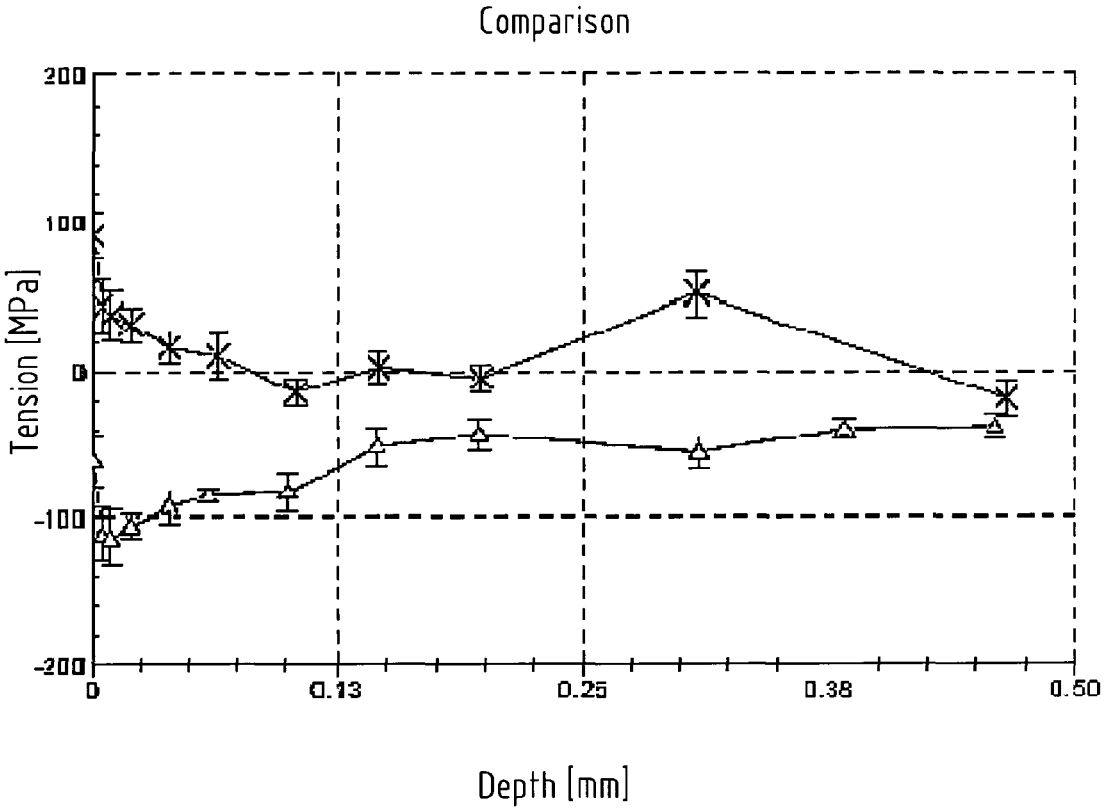
Comparison
200
100
0
-100
-200
Tension [MPa]
0
0.13
0.25
0.38
0.50
Depth [mm]

METHOD OF PRODUCING A SINTER-HARDENED COMPONENT

CROSS REFERENCE TO RELATED APPLICATIONS

This application is the National Stage of PCT/EP2008/004270 filed on May 29, 2008, which claims priority under 35 U.S.C. §119 of Austrian Application No. A 1371/2007 filed on Sep. 3, 2007. The international application under PCT article 21(2) was published in English.

The invention relates to a method of producing a sinter-hardened component from a metallic powder containing chromium, which has been pre-alloyed in particular, comprising the steps of compacting the powder to form a green compact and then sintering the green compact in a reducing sintering atmosphere at a sintering temperature in excess of 1,100° C., as well as to a component at least partially comprising a sintered material containing chromium and carbon from a metallic sintered powder, and the chromium content is selected from a range with a lower limit of 0.5% by weight and an upper limit of 7% by weight and the carbon content is at least 0.1% by weight.

The use of high-strength sintered alloys and methods of producing them for components in the automotive industry have long been known. For example, patent specification EP 0 835 329 B describes a method of producing a part using powder metallurgy which involves the following steps: mixing 0.8 to 2.0% by weight of graphite and lubricant with a pre-alloyed powder with a base of iron containing 0.5 to 3.0% by weight of molybdenum, which mixture does not contain any elementary iron, pressing the prepared mixture in order to shape it in a single pressing stage, and then sintering the pressed part at high temperature in a reducing atmosphere in order to obtain a sintered part with a density of more than 7.4 g/cm$^3$, rapidly cooling the sintered part from the austenitic phase and heating the part to virtually the temperature $A_1$ in order to spheroidise the carbides and minimise their separatoin along the grain boundaries. Admixing graphite with the initial powder for the green compact already means that the component produced by this method has an at least almost constant proportion of carbon through its entire cross-section. Such steels with high carbon contents have a high degree of hardness but the dynamic characteristic values of these materials are not able to satisfy the requirements placed on high-performance materials such as those used in more recent generations of engines.

Accordingly, the objective of the invention is to propose a method of producing a sinter-hardened component which is easy to implement as well as a component produced thereby.

This objective is achieved by the method outlined above, whereby a gas containing carbon is added to the sintering atmosphere, and by a component for which a gradient is provided for the carbon content, at least in the region of the component surface. The advantages are that there is no need for an additional step to incorporate a carbon carrier in the metallic powder because the increase in carbon concentration in the component or green compact can be effected simultaneously during the actual sintering process as it is being implemented. As a result of this approach, it is also possible to adjust the carbon content simply by regulating the quantity or regulating the flow for the gas containing carbon, depending on requirements, so that the preparatory steps for producing the green compacts remain unaffected and in principle, powder metallurgical components of differing hardness can be produced to suit requirements. Also of advantage is the fact that the method proposed by the invention also enables components to be produced which contain a higher proportion of carbon at their surface or in regions close to the surface than is the case in the entire base mass of the component. In this respect, it is naturally also possible to use pre-alloyed metal powders which already contain a certain proportion of carbon, in particular steel powder containing chromium. As a result of this graduation of the carbon element in the component itself, it is possible to impart a high hardness to it in the surface region, whereas the hardness in the layers lying underneath is lower. This enables powder metal components with high dynamic characteristic values to be produced, in particular components with improved values with regard to alternating bending stress. Accordingly, it is possible to produce components which are perfectly good in terms of their wear properties but are also better able to withstand alternating bending stress.

It is also of advantage if the component is cooled at a cooling rate of at least 2° C./s after sintering and as a result of this fast cooling (rapid cooling), patterned structures can be frozen in, thereby enabling an internal tension profile to be created within the structure with pressure tensions at the component surface.

In one embodiment of the invention, the proportion of gas containing carbon in the sintering atmosphere is selected from a range with a lower limit of 50 Nl/h and an upper limit of 300 Nl/h. It has been found that within these limits, regions of the component close to the surface are carburized at a sufficiently high rate so that the process as such is not lengthened or is lengthened to only a negligible degree as a result. In this respect, the quantity to be selected in each case will depend amongst other things on the carburizing gas used, i.e. the gas containing carbon, on the one hand, and will also be adapted to the cross-section of the actual sintering oven on the other hand. For example, the flows added to the reducing sintering atmosphere may be between 5 Nl/h and ca. 25 Nl/h for propane and between 50 Nl/h and 300 Nl/h for methane. In particular, the quantity to be added will depend on the proportion of carbon on the carburizing gas itself. Below 5 Nl/h, carburization is normally too slow and inadequate. Above 300 Nl/h, no improvement in the method was observed.

The Nl/h (Normal liter/hour) is based on a pressure of 1 bar (abs.) and a temperature of 20° C.

The proportion of chromium in the sinter powder is conducive to the hardenability of the component. The formation of Cr—carbides, imparts a high surface hardness to the component, which also increases resistance to wear.

For the gas containing carbon, i.e. carburizing gas, it is preferable to select a gas from a group comprising methane, propane or acetylene. The particular advantage of these gases is that they have a high carbon content and are easy to manipulate, and if using acetylene there are no problems during sintering due to the reducing sintering atmosphere.

It should be pointed out, however, that within the scope of the invention, other gases containing carbon may be used for this purpose, preferably gases which do not contain oxygen or any oxidising elements.

For the reducing sintering atmosphere, a mixture of nitrogen and hydrogen may be used in a manner known from the prior art, although in this case the ratio of $N_2$ to $H_2$ is selected from a range with a lower limit of 80:20 and an upper limit of 95:5. The high proportion of nitrogen is thus conducive to creating the reducing sintering atmosphere.

Particularly if using steel powders containing chromium, it has been found to be of advantage if cooling rates are selected from a range with a lower limit of 3° C./s and an upper limit of 10° C./s. At these rapid cooling rates within this range, the above-mentioned property profile of the components can be still further improved. In particular, the components produced exhibit a very good capacity to withstand alternating bending stress.

In order to improve this property profile still further, it is also possible within the scope of the invention to use cooling rates selected from a range with a lower limit of 4° C./s and an upper limit of 8° C./s or selected from a range with a lower limit of 5° C./s and an upper limit of 7° C./s.

The cooling rate for the rapid cooling operation is preferably selected so that the structure of the component undergoes a martensitic reaction across the entire cross-section. The advantage of the martensitic reaction is that a higher hardness can be imparted to the components.

During the cooling phase, no carburizing gas is added to the atmosphere and instead, cooling takes place under a protective gas atmosphere, thereby making it possible to create defined states and defined proportions of carbon easily. $N_2$, $NH_3$, noble gases, etc., may be used as a protective gas, for example.

In order to improve the property profile still further, in particular with a view to increasing the martensitic element, and provided the martensitic reaction has not fully taken place during the rapid cooling operation, it is preferable to temper the component after cooling, in particular at a temperature in the range of between 150° C. and 250° C. This enables undesired tensions such as those known to occur when tempering metallic components to be reduced. Although this causes a reduction in hardness, it does enable the toughness of the component to be improved, and the decrease in hardness in the region close to the surface can be at least compensated or improved by using a higher proportion of carbon in this region. Having been treated in this manner, the components have correspondingly high dynamic characteristic values throughout the major part of the component due to their corresponding toughness, in particular better ability to withstand alternating bending stress.

In particular, the tempering operation to improve these properties may be conducted at temperatures of between 150° C. and 200° C., in which case the martensitic proportion is at least partially converted into ϵ-carbides ($Fe_xC$) and into so-called cubic martensite if the carbon content is in excess of 0.2%.

In this context, the proportion of chromium is of advantage because tempering can be operated at higher temperatures due to the chromium element, especially because the conversion of residual austenite into carbides and ferrite is postponed at a higher temperature. Consequently, the tempering process can be operated more quickly, i.e. in a shorter time, without running the risk of ferritic proportions being contained in the component.

It is also possible to implement the method in such a way that a gradient for the carbon content is created in the component, at least in the regions close to the surface. It is possible to achieve this because after the carburuzing process during sinter-hardening, there is not enough time for the carbon to compensate for the carbon content due to diffusion processes as a result of the rapid cooling. Alternatively, this can be achieved on the basis of a specific temperature control, for example a higher initial temperature during the sinter-hardening process, as a result of which carburization takes place very rapidly in the regions close to the surface and because the carbon diffuses, this carburization takes place in deeper regions close to the surface, and the temperature is then reduced precisely in order to prevent this diffusion and hence compensation of the carbon concentration. As another alternative, this can also be achieved on the basis of specifically selected flow compositions or selected gas flows with differing proportions of carburizing gases in the reducing sintering atmosphere. It is of advantage to create a carbon gradient with a view to obtaining components with high dynamic characteristic values, in particular a high ability to withstand alternating bending stresses, because the higher hardness is essentially restricted to regions close to the surface, and the component has a higher toughness in its depth because the carbon content is lower there than in the regions close to the surface.

The rapid cooling process may be run until the tempering temperature is reached on the one hand and, on the other hand, it is possible to cool the components to room temperature and then heat to tempering temperature again.

The gradient for the carbon content is preferably selected from a range with a lower limit of 0.3% by weight/mm layer thickness and an upper limit of 1.5% by weight/mm layer thickness of the components. To obtain a further improvement in the property profile of the component, it is possible to select this gradient in carbon content from a range with a lower limit of 0.5% by weight/mm layer thickness and an upper limit of 1% by weight/mm layer thickness, in particular to select it from a range with a lower limit of 0.6% by weight/mm layer thickness and an upper limit of 0.75% by weight/mm layer thickness.

The gradient for the carbon content is created starting from the component surface down to a component depth of 0.8 mm, in order to impart improved toughness to the interior of this component. In particular, it is possible for the gradient in carbon content to be created starting from the component surface down to a component depth of 0.5 mm, preferably 0.3 mm to 0.4 mm.

In this respect, the carbon gradient may decrease linearly or may follow a curve function, such as a quadratic curve, a logarithmic curve, etc.

To provide a clearer understanding, the invention will be explained in more detail below with reference to an example.

The appended drawing is a schematic diagram showing:

FIG. 1 the results of measurements taken on a component proposed by the invention in respect of internal tension compared with a component from the prior art.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

In order to produce a powder metallurgical component, a pre-alloyed steel powder containing chromium is used. It may be based on the following composition—leaving aside impurities in the elements due to the production process:

Cr 1% by weight—4% by weight

C 0.2% by weight—0.7% by weight

Cu 0.5% by weight—2.5% by weight

Fe making up the rest.

It may also contain other alloying elements such as Ni, Mo, Mn, Si, V, W or Al, for example, in a total quantity of at most 10% by weight, provided that the proportion of no element is in excess of 4.5% by weight.

As a general rule, it is not only possible to use steel powder but also steel powder with a base of ferro-alloys or master alloys containing chromium.

In this example of an embodiment, the powder used was one already containing a basic carbon content of ca. 0.3% by weight, which remains at least more or less constant across the entire cross-section of the component.

This powder was compressed in standard pressing dies to form what is known as a green compact in a manner known from the prior art. It is possible to opt for unidirectional pressing or alternatively isostatic pressing, for example. It is also possible to use bidirectional methods, in other words compressing the green compacts from above and from underneath.

It goes without saying that other processing agents may be added to the powder, such as lubricants such as tin stearate or similar for example, with a view to obtaining better formability or better compressibility to achieve higher sintering densities.

This green compact was then heated to a temperature of between 1,120° C. and 1,300° C. in a conveyor belt sintering oven.

Within the context of the invention, it is naturally possible to use other sintering units or sintering ovens, such as walking beam furnaces, for example.

Conveyor belt sintering ovens are widely known from the prior art and are used to produce sintered materials on a continuous basis.

Using a higher sintering temperature, in other words in the range of 1,300° C., on the one hand leads to a more homogeneous distribution of the alloying elements due to increased diffusion and on the other hand results in a better sintering quality, thereby enabling denser components to be produced.

The sinter-hardening process was operated under a reducing atmosphere comprising nitrogen and hydrogen in a ratio of 85:15. Added to this reducing atmosphere as a carburizing gas was propane in a quantity of 22 Nl/h in order to carburize the regions close to the surface during the sintering process. The green compacts are sintered for a period of 30 min and then transferred by the conveyor belt of the conveyor belt oven into a rapid cooling zone, where they are cooled at a cooling rate of at least 3° C./s to 5° C./s, and even better below the tempering temperature of 220° C. To this end, the conveyor belt sintering oven preferably has a separate tempering zone adjoining the rapid cooling zone.

In the tempering zone, the sintered components were maintained at the tempering temperature for a period of 20 min to 30 min, depending on the component weight.

These components are then cooled to room temperature.

As a result, the components produced had a structure that was exclusively martensitic with a graduated carbon curve in the region close to the surface down to a component depth of 0.4 mm. The carbon content obtained in the region close to the surface was 0.5 to 0.6% by weight and this decreased to the initial content of 0.3% by weight after a depth of 0.3 to 0.4 mm depending on the pre-alloyed steel powder.

This component was then subjected to an internal stress measurement and compared with a component with no carbon gradient known from the prior art. The result of this internal stress measurement on unnotched alternating bending samples may be seen in FIG. 1.

In FIG. 1, the curve at the bottom plots internal stress as a function of the component depth in mm compared with the tension in MPa. As clearly demonstrated, the bottom curve plotting the component proposed by the invention exhibits a better internal stress profile than the component of the prior art plotted by the curve at the top.

Similar results have been achieved with samples containing 0.4% by weight C (sintering temperature 1280° C.), 0.6% by weight C and 2.0% by weight Cu (sintering temperature 1280° C.) or 0.7% by weight C and 1.0% by weight Cu (sintering temperature 1120° C.). The proportion of chromium may be between 1% by weight and 5% by weight.

A whole range of different sintered components may be produced using the method proposed by the invention, in particular sintered steel parts such as required for components in the automotive industry for example, in particular for transmissions, such as synchroniser rings, synchroniser hubs, etc. In addition to the sintered material, the components may also incorporate other materials, for example if the sintered material is disposed on a metallic substrate.

The embodiments illustrated as examples represent possible design variants and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

The objective underlying the independent inventive solutions may be found in the description.

The invention claimed is:

1. A method of producing a sinter-hardened component from a metallic powder containing chromium comprising the steps of compacting the powder to form a green compact and then sintering the green compact in a reducing sintering atmosphere at a sintering temperature in excess of 1100° C., wherein a gas containing carbon is added to the sintering atmosphere, wherein after sintering, the component is cooled at a cooling rate of at least 2° C./s, wherein a carbon concentration in the green compact is increased simultaneously during the sintering, wherein a gradient is created for the carbon content in regions starting from a component surface down to a component depth of 0.8 mm, and wherein the gradient for the carbon content is selected from a range with a lower limit of 0.3% by weight/mm layer thickness and an upper limit of 1.5% by weight/mm layer thickness of the component.

2. The method as claimed in claim 1, wherein the proportion of gas containing carbon in the sintering atmosphere is selected from a range with a lower limit of 50 Nl/h and an upper limit of 300 Nl/h.

3. The method as claimed in claim 1, wherein the gas containing carbon is at least one gas selected from the group consisting of methane, propane, and acetylene.

4. The method as claimed in claim 1, wherein the sintering atmosphere prior to adding the gas containing carbon is a mixture of nitrogen and hydrogen in a ratio of $N_2/H_2$ selected from a range with a lower limit of 80/20 and an upper limit of 95/5.

5. The method as claimed in claim 1, wherein the cooling rate is selected from a range with a lower limit of 3° C./s and an upper limit of 10° C./s.

6. The method as claimed in claim 1, wherein cooling causes at least a portion of the structure of the component to undergo a martensitic reaction.

7. The method as claimed in claim 1, wherein cooling takes place under a protective gas atmosphere.

8. The method as claimed in claim 1, wherein the component is tempered after cooling.

9. The method as claimed in claim 8, wherein the component is tempered after cooling at a temperature in the range of between 150° C. and 250° C.

* * * * *